US007569950B1

(12) United States Patent
Yang

(10) Patent No.: US 7,569,950 B1
(45) Date of Patent: Aug. 4, 2009

(54) ENHANCED STRUCTURE OF PLUG SWITCHES

(76) Inventor: Hsiu-Ling Yang, No. 2, Lane 6, Lin sen Road, Tauyuan (TW)

( * ) Notice: Subject to any disclaimer, the term of this patent is extended or adjusted under 35 U.S.C. 154(b) by 0 days.

(21) Appl. No.: 12/143,303

(22) Filed: Jun. 20, 2008

(51) Int. Cl.
*H01H 35/14* (2006.01)

(52) U.S. Cl. ..... 307/117; 362/95

(58) Field of Classification Search ..... 307/117; 362/95; 439/620.01, 620.15; 174/66; 315/312
See application file for complete search history.

(56) References Cited

U.S. PATENT DOCUMENTS 5,077,484 A * 12/1991 Tsai et al. ..... 307/39
5,673,022 A * 9/1997 Patel ..... 340/565
6,000,807 A * 12/1999 Moreland ..... 362/95
6,350,039 B1 * 2/2002 Lee ..... 362/95
6,891,284 B2 * 5/2005 Tilley ..... 307/116
7,036,948 B1 * 5/2006 Wyatt ..... 362/95
7,155,317 B1 * 12/2006 Tran ..... 700/259
7,258,575 B1 * 8/2007 Weng ..... 439/620.01
2003/0016129 A1 * 1/2003 Menard et al. ..... 340/531
2003/0092297 A1 * 5/2003 Reindle et al. ..... 439/107
2006/0267788 A1 * 11/2006 Delany ..... 340/815.45

* cited by examiner

*Primary Examiner*—Albert W Paladini
*Assistant Examiner*—Daniel Cavallari
(74) *Attorney, Agent, or Firm*—WPAT, P.C.; Anthony King

(57) ABSTRACT

The invention discloses an enhanced structure of plug switches, comprising a housing; a plurality of emitting units disposed on the housing; a plug switch unit disposed on the housing and at least includes a frame, a socket set, and a switch set; a control unit disposed in the housing and connected to the emitting units, the socket set, the switch set, and an external electrical source, at least including a circuit board, a photosensitive resistance disposed on the circuit board, and switches disposed on the circuit board for controlling the socket set. Therefore, when users turn off light sources, the users may use the control unit to turn on the emitting units and turn off the plug switch unit automatically, or decide whether to leave the plug switch unit conductive or not by using the control unit, which increases visible light sources, saves energy, and prevents accidents from occurring.

3 Claims, 3 Drawing Sheets

ENHANCED STRUCTURE OF PLUG SWITCHES

FIELD OF THE INVENTION

The invention relates to an enhanced structure of plug switches, more particularly to an enhanced structure of plug switches that allows users to turn on the emitting units and turn off the plug switch unit automatically by using a control unit when light sources of the surrounding environment are turned off, or decide whether to leave the plug switch unit conductive or not by using the control unit, which increases visible light sources, saves energy, and prevents accidents from occurring.

DESCRIPTION OF PRIOR ART

Conventionally, a plug switch comprises a frame, a board disposed on a surface of the frame, and a plurality of socket sets and switch sets disposed on the frame and exposed through the board; such that the plug switch may be disposed at a desired location in an environment, and electrically connected to a main power cable and related lighting devices. Consequently, the socket sets may be allowed to supply power for electronic devices, and the switch sets may be used to turn the related lighting devices on and off.

Although the aforesaid plug switch may be used to supply power for the electronic devices and turn the related lighting devices on and off; when light sources of an environment are turned off and thus leaving the environment in darkness, and a user enters the environment, the user must search for the switch set in darkness so as to turn on the related lighting devices for illumination, which is inconvenient to use. Moreover, whether the socket set is used by the user or not, the socket set is generally left electrically conductive, which means if the user leaves the environment without unplugging the electronic devices, it leads to a waste of electricity and also gives rise to accidents resulted from power overload.

SUMMARY OF THE INVENTION

Consequently, a main objective of the invention is to propose an enhanced structure of plug switches, which allows users to turn on the emitting units by using the control unit when light sources of an environment are turned off, and automatically turn off the plug switch unit at the same time, or decide whether to leave the plug switch unit conductive or not by using the control unit, which increases visible light sources, saves energy, and prevents accidents from occurring.

To achieve the aforesaid objective, an enhanced structure of plug switches has been disclosed in the invention, comprising: a housing; a plurality of emitting units separately disposed on an internal perimeter of the housing; a plug switch unit being disposed on a surface of the housing, which at least includes a frame, as well as a socket set and a switch set disposed on the frame; a control unit disposed in the housing and electrically connected to the emitting units, the socket set, the switch set, and an external electrical source, which at least includes a circuit board, a photosensitive resistance being disposed on the circuit board, and switches disposed on the circuit board and on a surface of the housing for controlling the socket set.

DETAILED DESCRIPTION OF PREFERRED EMBODIMENTS

Figure 1:
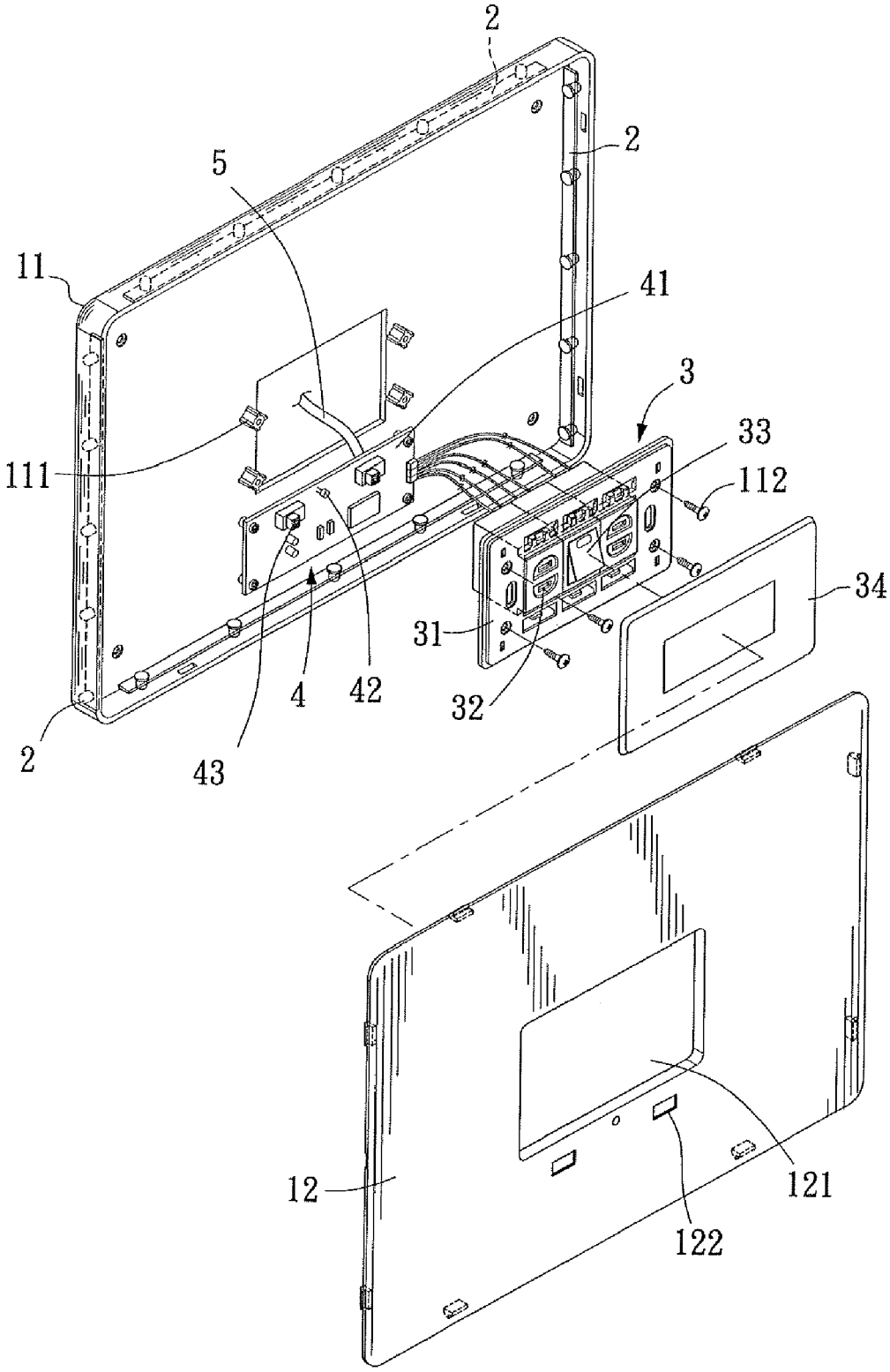
FIG. 1 is a schematic view that shows a disassembled structure of a plug switch according to the invention.
Figure 2:
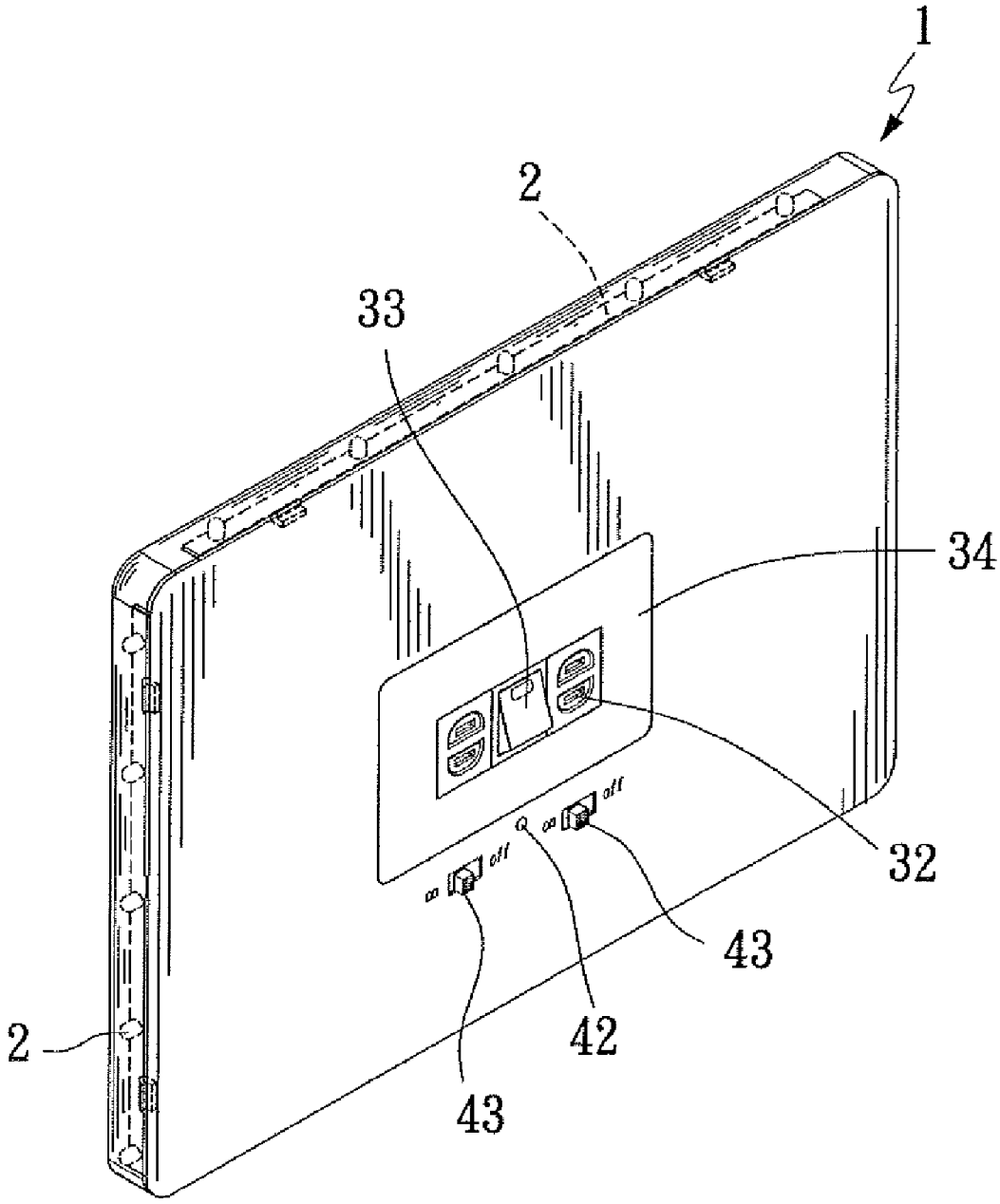
FIG. 2 is a schematic view that shows an assembled structure of a plug switch according to the invention.

Referring to FIGS. 1 and 2, which are schematic views that show a structure of a plug switch in both disassembled and assembled states according to the invention. The drawings show that: The invention discloses an enhanced structure of plug switches, which is at least comprised of a housing 1, a plurality of emitting units 2, a plug switch unit 3, and a control unit 4.

The aforesaid housing 1 at least includes a base 11 and a cover board 12 for sealing off the base 11; the base 11 has a plurality of positioning columns 111 thereon, and the cover board 12 has an opening 121 and long openings 122 disposed thereon, respectively.

Each of the emitting units 2 is separately disposed on an internal perimeter of the housing 1.

The plug switch unit 3 is disposed on a surface of the housing 1, and secured onto the positioning columns 111 of the base by using fixing components 112, and at least includes a frame 31, as well as a socket set 32 and a switch set 33 disposed on the frame 31, wherein a surface of the frame 31 has a board 34 thereon, and the board 34 may be correspondingly embedded into the opening 121 of the housing 1.

The control unit 4 is disposed in the housing 1 and electrically connected to the emitting units 2, the socket set 32, the switch set 33, and a main power cable 5, respectively, which at least includes a circuit board 41, a photosensitive resistance 42 being disposed on the circuit board 41 and facing a surface of the housing 1, and switches 43 being disposed on the circuit board 41 and within the long openings 122 of the housing 1 for controlling the socket set 32. Consequently, the aforesaid structure constitutes an enhanced structure of plug switches.

Figure 3:
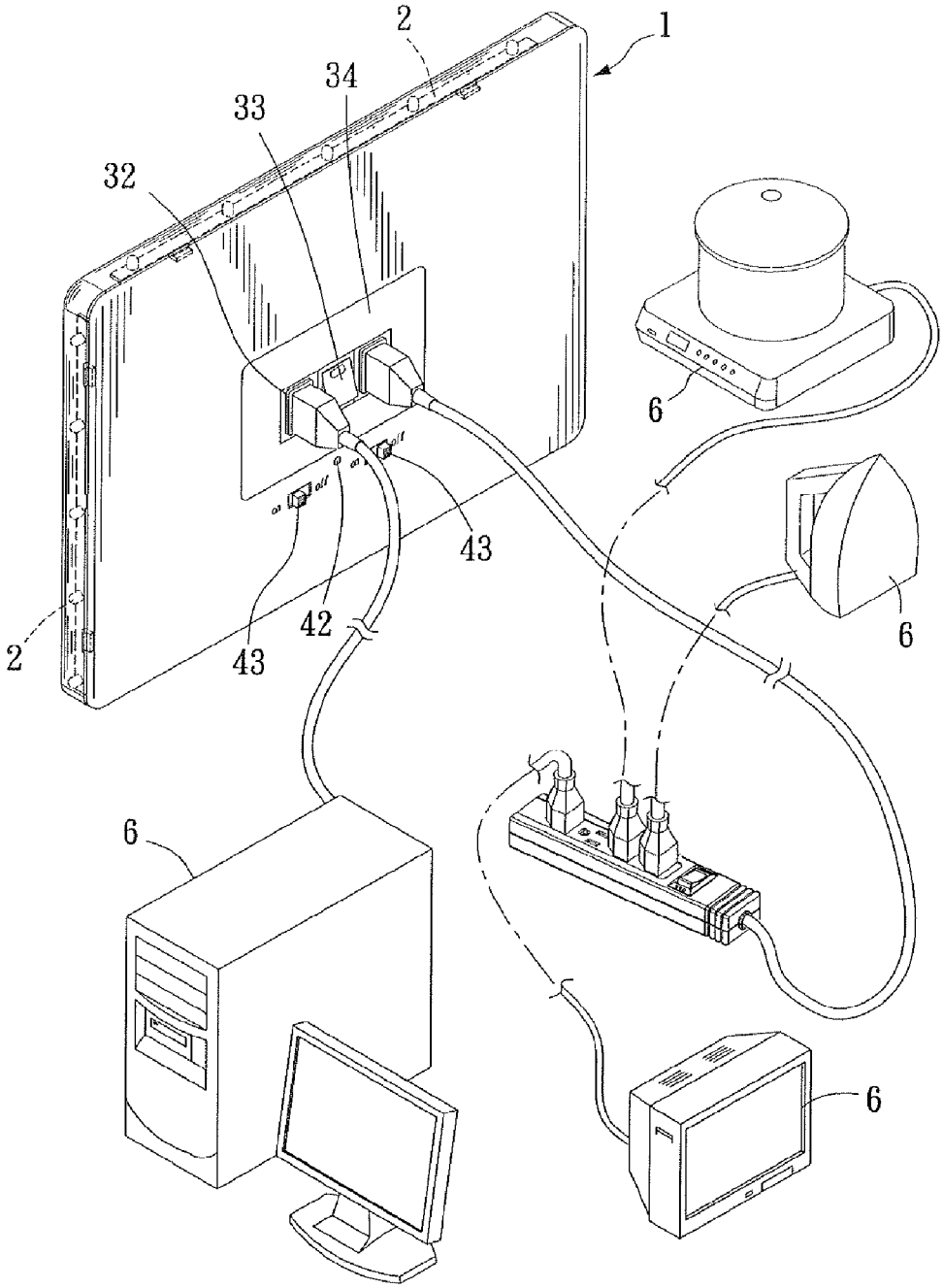
FIG. 3 is a schematic view that shows a plug switch in use according to the invention.

Referring to FIG. 3, it is a schematic view that shows a plug switch in use according to the invention. The drawing shows that: when the structure of the invention is put to use, the structure may be disposed at a predetermined location in a desired environment, and one or more socket sets 32 and switch sets 33 may be disposed according to actual requirements.

During usage (refer to FIG. 1 in combination), a required electronic device 6 may be plugged into one of the socket sets 32, so that the electronic device 6 may be supplied with the necessary power for operating or recharging. When a user is to leave an environment where he/she is, and turns off related lighting devices by using the switch set 33, the photosensitive resistance 42 of the control unit 4 senses changes in settings of the external environment, subsequently turns on the emitting units 2 and deactivates the socket set 32. Therefore, visible light sources in the environment may be increased, or the structure may be used as a night lamp, while it also saves energy and prevents accidents from occurring.

When the user turns off the switch set 33 and deactivates the socket set 32, the user may still reactivate the socket set 32 by using the switches 43 of the control unit 4 if required, so as to consistently supply power to the electronic device 6 according to actual requirements. When the user is to exit the environment, he/she may choose to deactivate the socket sets

32 where dangerous electronic devices 6 such as television sets, electric irons, and electric ovens are plugged into, while other electronic devices 6 like refrigerators and computers may be allowed to operate as required. As a result, energy may be saved, and accidents may be prevented from occurring, which makes the structure of the invention more convenient to use according to actual needs.

In sum, the enhanced structure of plug switches of the invention may effectively eliminate the disadvantages of the prior arts, such that when users turn off light sources in an environment, the users may also use the control unit to activate the emitting units, and automatically deactivate the plug switch unit, or decide whether to leave the plug switch unit conductive or not by using the control unit, which increases visible light sources, saves energy, and prevents accidents from occurring. It is therefore evident that the enhanced structure of plug switches of the invention has been enhanced in terms of functions, usage, and convenience of users, which has satisfied the criteria for applying for patent rights.

It is apparent to those skilled in the art that the foregoing description is only illustrative of the preferred embodiments. It is not intended to restrict the scope of the present invention. Thus, all equivalent modifications and variations made in the foregoing embodiment according to appended claims should fall within the scope of the invention.

What is claimed is:

1. An enhanced structure of plug switches, comprising:

a housing;

a plurality of emitting units, separately disposed on an internal perimeter of the foregoing housing;

a plug switch unit disposed on a surface of the foregoing housing, which at least includes a frame, as well as a socket set and a switch set disposed on the frame; and a control unit disposed in the foregoing housing and electrically connected to the emitting units, the socket set, the switch set, and an external electrical source, respectively, which at least includes a circuit board, a photosensitive resistance being disposed on the circuit board and allowed to face a surface of the housing, and switches being disposed on the circuit board and on a surface of the housing for controlling the socket set.

2. The enhanced structure of plug switches of claim 1, wherein the housing at least includes a base and a cover board for sealing off the base, and the base has positioning columns for combining with fixing components in order to secure the plug switch unit, while the cover board has an opening corresponding to the plug switch unit, and long openings corresponding to the switches.

3. The enhanced structure of plug switches of claim 1, wherein a surface of the frame of the plug switch unit has a board thereon, and the board is embedded into a surface of the foregoing housing.

* * * * *